US005189760A

United States Patent [19]

Aisley

[11] Patent Number: 5,189,760

[45] Date of Patent: Mar. 2, 1993

[54] MEDICINE CABINET

[75] Inventor: William J. Aisley, Malibu, Calif.

[73] Assignee: Zaca, Inc., Westlake Village, Calif.

[21] Appl. No.: 864,328

[22] Filed: Apr. 6, 1992

Related U.S. Application Data

[62] Division of Ser. No. 576,069, Aug. 31, 1990, Pat. No. 5,139,322.

[51] Int. Cl.[5] ..... E05D 3/06

[52] U.S. Cl. ..... 16/317; 16/312; 16/357; 16/359; 16/348; 16/DIG. 13

[58] Field of Search ..... 16/312-315, 16/344, 317, 348, 357-359, DIG. 13; 312/351; 49/383

[56] References Cited

U.S. PATENT DOCUMENTS 4,953,259 9/1990 Frye et al. ..... 16/348

*Primary Examiner*—Robert L. Spruill
*Assistant Examiner*—Donald M. Gurley
*Attorney, Agent, or Firm*—Kelly Bauersfeld & Lowry

[57] ABSTRACT

An improved medicine cabinet is constructed predominantly from molded plastic components adapted for rapid assembly. The medicine cabinet includes a forwardly open main housing having preformed grooves therein which cooperate with one or more upright central shelf support brackets to support an array of half width shelf members in a customized geometry of half and full width shelves. The medicine cabinet further includes an improved self-closing hinge assembly for swingably supporting a mirror door from the cabinet housing, wherein the hinge assembly does not require metal parts. The mirror door includes a recessed baseplate for stable nested reception of a glass mirror, in combination with an improved mirror frame adapted for simple snap fit mounting onto the baseplate.

9 Claims, 8 Drawing Sheets

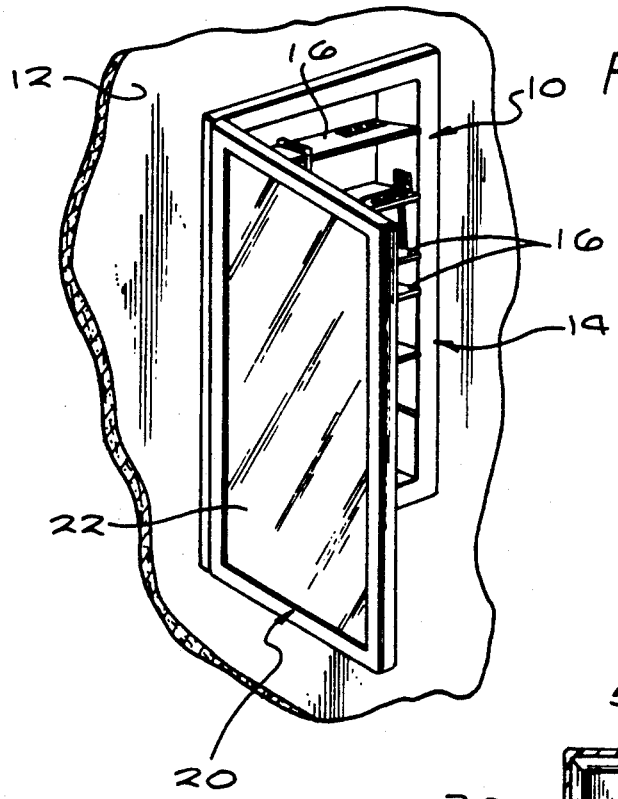
FIG. 1
FIG. 4
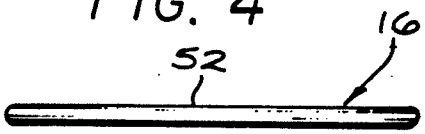
FIG. 3
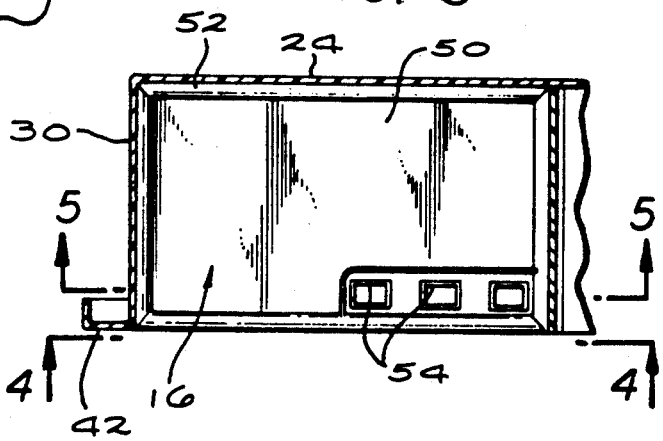
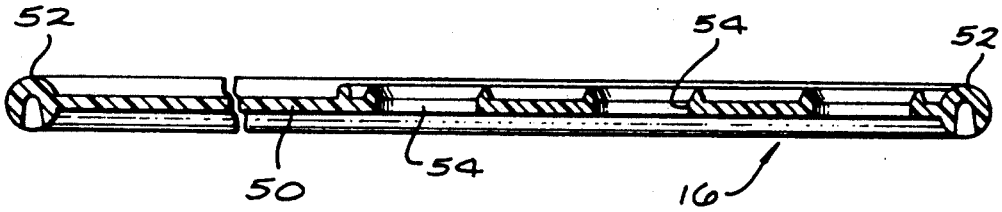
FIG. 5

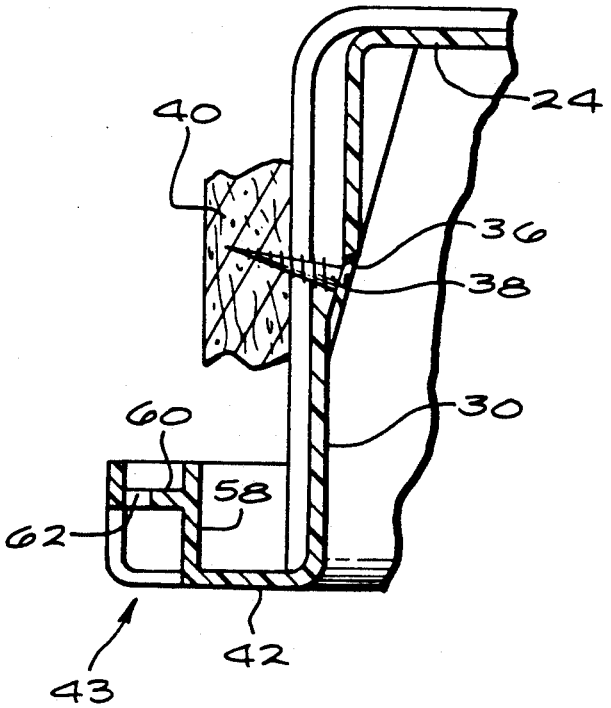
FIG. 8
FIG. 9
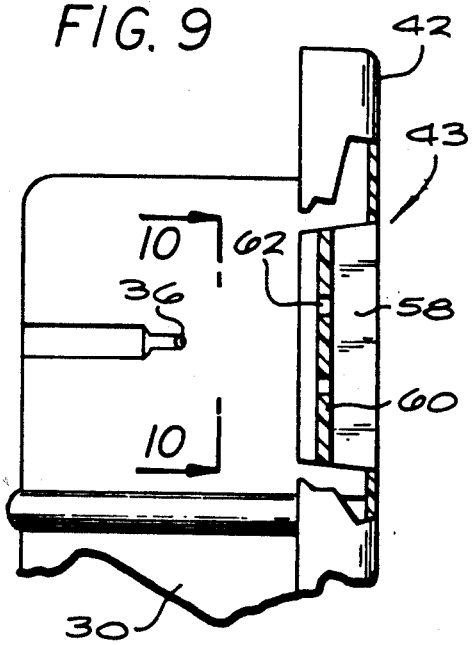
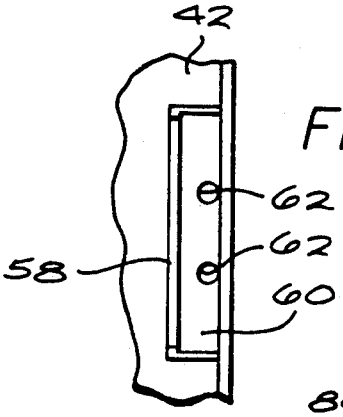
FIG. 10
FIG. 17
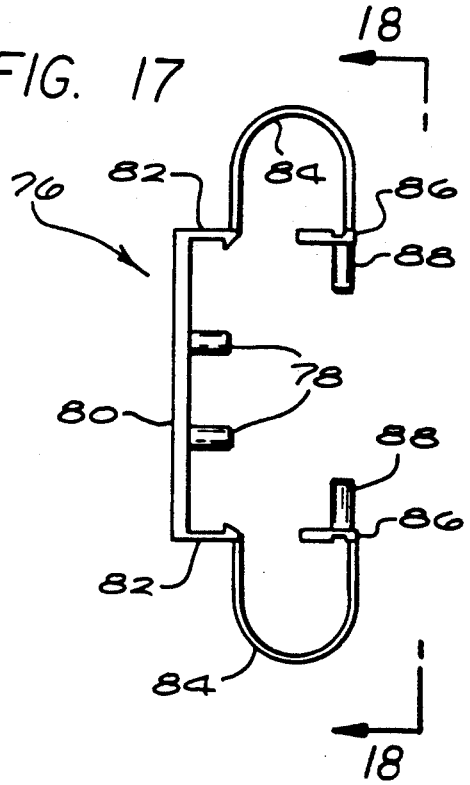
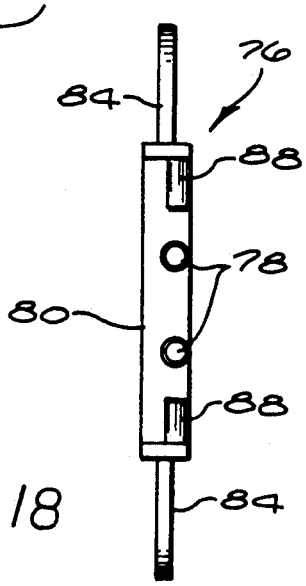
FIG. 18

FIG. 12
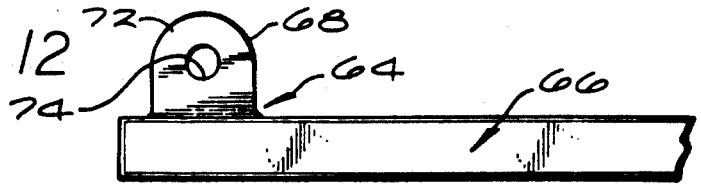
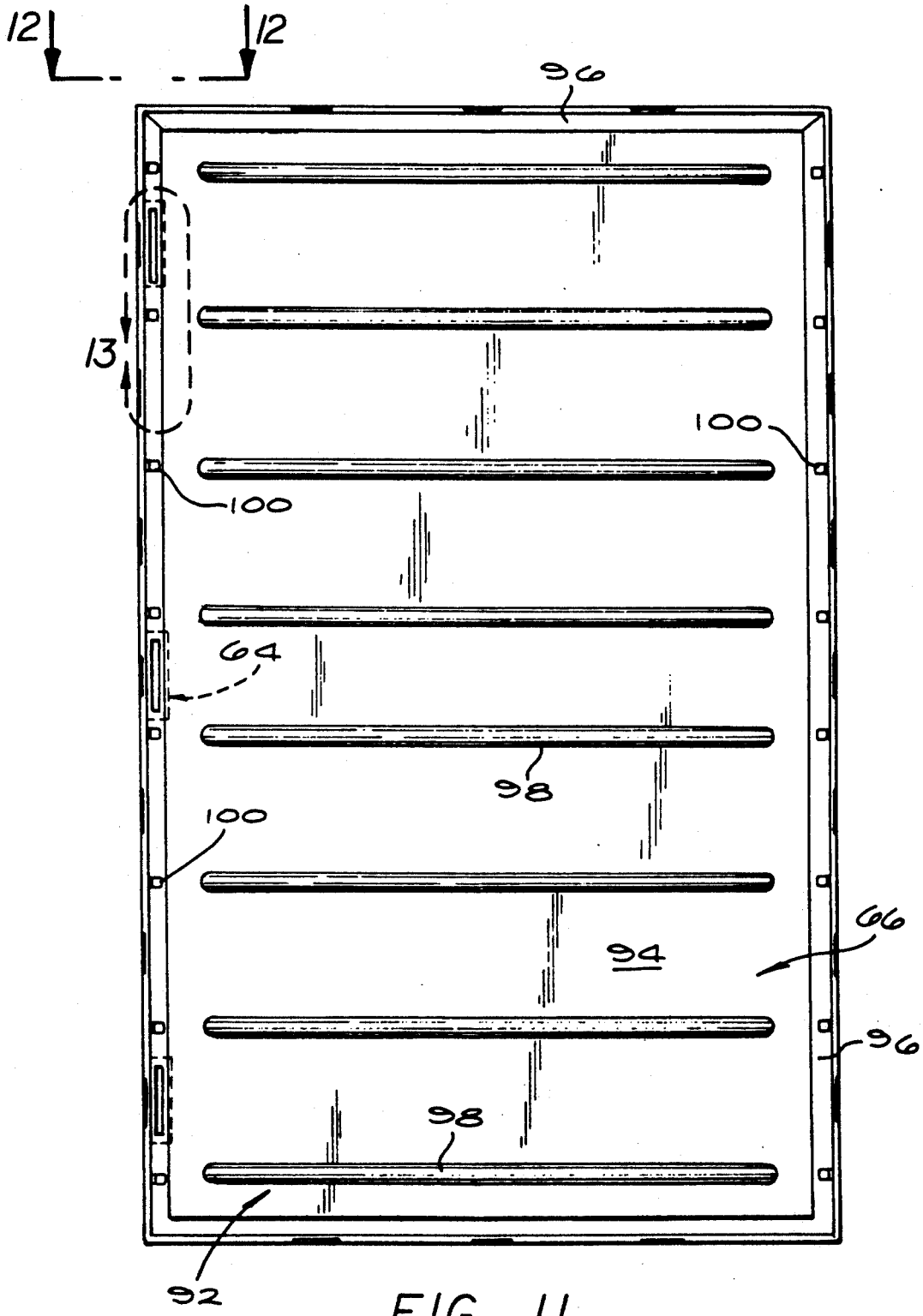
FIG. 11

FIG. 13
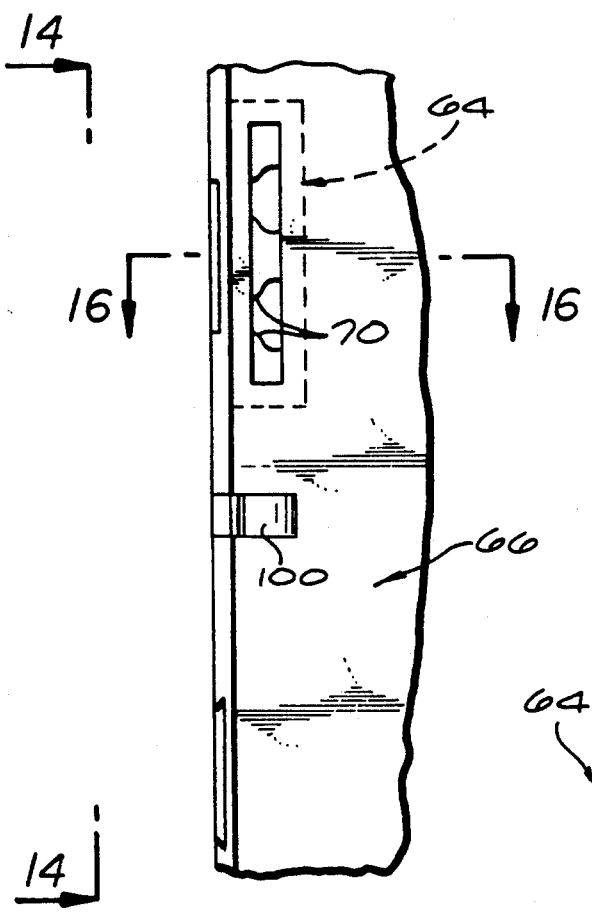
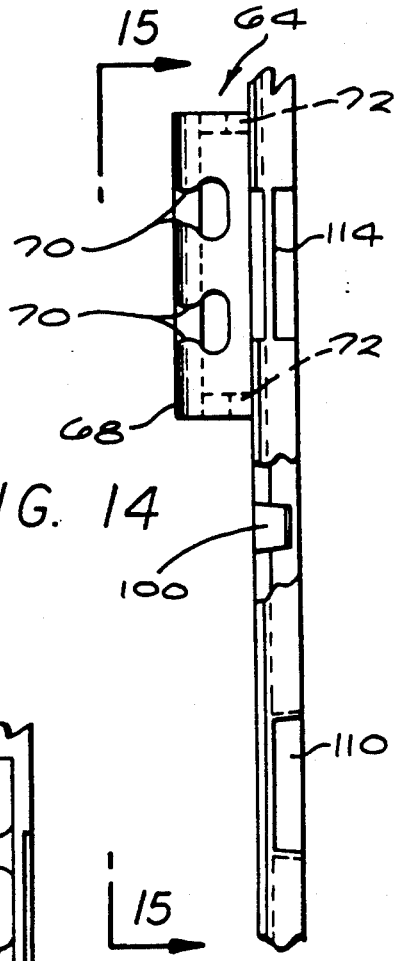
FIG. 14
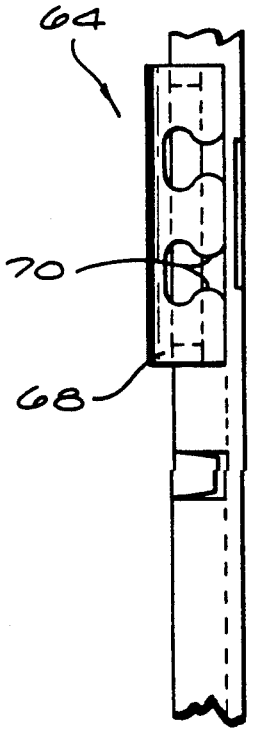
FIG. 15
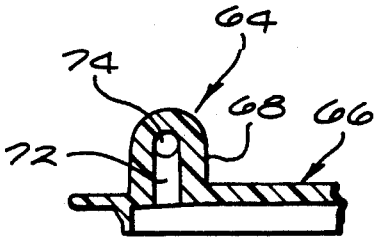
FIG. 16

MEDICINE CABINET

BACKGROUND OF THE INVENTION

This invention relates generally to medicine cabinets of the type used in residential dwellings and the like to store medicines and toiletries, etc. More particularly, this invention relates to an improved medicine cabinet constructed predominantly from molded plastic components and providing a highly versatile shelf geometry, an improved self-closing hinge assembly, and an improved mirror door for receiving and supporting a glass plate mirror in a secure and stable manner.

Medicine cabinets are known for use in storing medicines and toiletries, etc. in residential dwellings. Traditional medicine cabinets have commonly comprised a shallow and forwardly open cabinet housing constructed as a metal stamping and adapted to fit into the wall of a residential bathroom or the like during the construction phase. A mirror door is hingedly mounted at one side of the cabinet housing for swinging movement between closed and open positions, with a magnetic or friction spring catch being provided to hold the door in the closed position. When closed, the mirror door supports a mirror formed typically from glass plate in a position for convenient use in the application of cosmetics, shaving, and other toiletry prodecures. In the open position, the mirror door exposes the cabinet interior which includes an array of shelves for supporting medicines and toiletry articles.

Although medicine cabinets of the above-described general type having been extremely well-known for many years, the traditional cabinet construction incorporates a variety of inherent limitations and disadvantages. For example, while some cabinet designs have permitted some adjustable selection of shelf position, prior art cabinets with adjustable shelves have generally been limited to an array of shelves spanning the full width of the cabinet interior. Accordingly, when one or a small number of relatively tall articles such as a bottle containing mouthwash or the like is stored within the cabinet, it has been necessary to provide an entire shelf with sufficient clearance to accept the tall bottle. This approach has unfortunately resulted in significant wasted space within the medicine cabinet, since the user rarely has a sufficient number of tall bottles to occupy an entire shelf width.

In addition, previous medicine cabinet designs have incorporated a significant number of metal components which can deteriorate due to rust in a damp bathroom environment. In some cases, this failure mode has been recognized and addressed by the use of a plastic material to form the cabinet housing, but metal components have still been used to form hinges and catches associated with the mirror door. The use of such metal parts in the cabinet construction is further undesirable since they contribute to noisy operation when the mirror door is opened or closed.

Prior medicine cabinet designs have also encountered difficulties in providing secure and stable support for a plate glass mirror on the mirror door. More particularly, the glass mirror is typically sandwiched between a door baseplate and a lightweight peripheral frame, with the combined structure of the baseplate and frame cooperating to support the comparatively heavy weight of the mirror. A cardboard backing is normally placed between the mirror and the baseplate to provide a spring action pressing the mirror firmly against the frame. Unfortunately, this arrangement exposes the fragile mirror to nonuniform retention forces which contribute to mirror breakage, especially during shipment of the medicine cabinet to a construction site. Moreover, in the damp bathroom environment, the cardboard backing tends to lose its resiliency over a period of time, such that the glass mirror becomes loose and is thus exposed to increased risk of breakage.

There exists, therefore, a significant need for improvements in the design and construction of a medicine cabinet, particularly with respect to improved versatility in the arrangement of adjustable shelves, an improved hinge assembly designed for long term and silent operation, and an improved mirror door construction for safe and stable support of a glass plate mirror. The present invention fulfills all of these needs and provides further related advantages.

SUMMARY OF THE INVENTION

In accordance with the invention, an improved medicine cabinet constructed predominantly from molded plastic parts is adapted to provide a customized arrangement of full and/or half width cabinet shelves within a main cabinet housing. A mirror door is hingedly connected onto the main housing by improved self-closing and substantially silent operating hinge assemblies. The mirror door further provides an improved mounting arrangement for receiving and supporting a glass plate mirror in a secure and stable manner.

The main cabinet housing is constructed as a plastic molding to define a forwardly open cabinet body adapted for installation into the wall of a building. The interior of the main housing includes at least one and preferably two centrally located upright shelf brackets which protrude forwardly from a rear housing wall into the housing interior. Preformed shelf grooves are formed in the housing rear and associated side walls as well as in the shelf brackets to define a plurality of mounting locations for a series of preformed half width shelf members. Accordingly, the shelf members can be installed into the housing in a variably selected array to provide a custom geometry of half width shelves, with omission of shelf members at selected locations providing half width shelves of selected height to permit storage of bottles or other tall articles. Importantly, the shelf support brackets are spaced from top and bottom walls of the cabinet housing such that full width shelves may be defined at those locations. When two shelf brackets are provided, the brackets are vertically spaced for each other to provide an additional full width shelf therebetween.

The cabinet housing includes a plurality of hinge mounting seats along one side thereof and forming a portion of a corresponding plurality of reversible hinge assemblies adapted to support a mirror door for left- or right-hand swinging movement between open and closed positions. The hinge mounting seats are interlocked with preformed cam hinge units on a door baseplate by means of hinge pin units designed for construction as plastic moldings. The hinge pin units cooperatively engage cam surfaces of the cam hinge units during pivoting motion of the mirror door for substantially silent and reliable self-closing door operation.

The mirror door baseplate includes a shallow and forwardly open mirror cavity for nested reception of a mirror formed typically from glass plate. The mirror door is also preferably formed as a plastic molding and includes a plurality of integrally formed leaf springs for resiliently supporting the mirror which may have a thickness falling within a range commonly encountered in medicine cabinets. A plastic molded mirror frame is designed for snap-fit interlock with the baseplate to retain the mirror in place, with the frame and baseplate additionally including interfitting dovetail members to lock the frame against lateral separation from the baseplate. In an alternative form, a metal mirror frame is snapfit mounted onto the baseplate by means of a plurality of spring tabs positioned to seat within baseplate apertures formed conveniently adjacent the mirror springs.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented perspective view illustrating an improved medicine cabinet embodying the novel features of the invention;

FIG. 3 is an enlarged and fragmented horizontal sectional view taken generally on the line 3—3 of FIG. 2;

FIG. 4 is front elevation view of a preformed shelf for use with the medicine cabinet, as viewed generally on the line 4—4 of FIG. 3;

FIG. 5 is an enlarged fragmented vertical sectional view of the shelf, taken generally on the line 5—5 of FIG. 3, to depict construction details thereof;

FIG. 8 is an enlarged fragmented horizontal sectional view taken generally on the line 8—8 of FIG. 6, and illustrating mounting of the main housing to wall studs of a conventional wall structure;

FIG. 9 is a fragmented side elevational view of a portion of the main cabinet housing, taken generally on the line 9—9 of FIG. 6, and depicting a preformed hinge mounting seat;

FIG. 10 is a fragmented rear elevational view of the hinge mounting seat, taken generally on the line 10—10 of FIG. 9;

FIG. 11 is a front elevational view of a mirror door baseplate for hinged mounting onto the main cabinet housing;

FIG. 12 is an enlarged fragmented top plan view of a portion of the door baseplate, taken generally on the line 12—12 of FIG. 11;

FIG. 13 is an enlarged fragmented front elevational view of a portion of the door baseplate, corresponding generally with the encircled region 13 of FIG. 12 and showing a preformed cam hinge unit on the baseplate:

FIG. 14 is an enlarged fragmented side elevational view of the cam hinge unit, as viewed generally on the line 14—14 of FIG. 13;

FIG. 15 is an enlarged fragmented rear elevational view of the cam hinge unit, as viewed generally on the line 15—15 of FIG. 14;

FIG. 16 is a fragmented horizontal sectional view taken generally on the line 16—16 of FIG. 13;

FIG. 17 is a side elevational view of a preferred hinge pin unit for rotatably interconnecting the cam hinge unit on the door baseplate with the hinge mounting seat on the main cabinet housing;

FIG. 18 is a front elevational view of the hinge pin unit, taken generally on the line 18—18 of FIG. 17;

DETAILED DESCRIPTION OF THE PREFERRED EMBODIMENT

Figure 2:
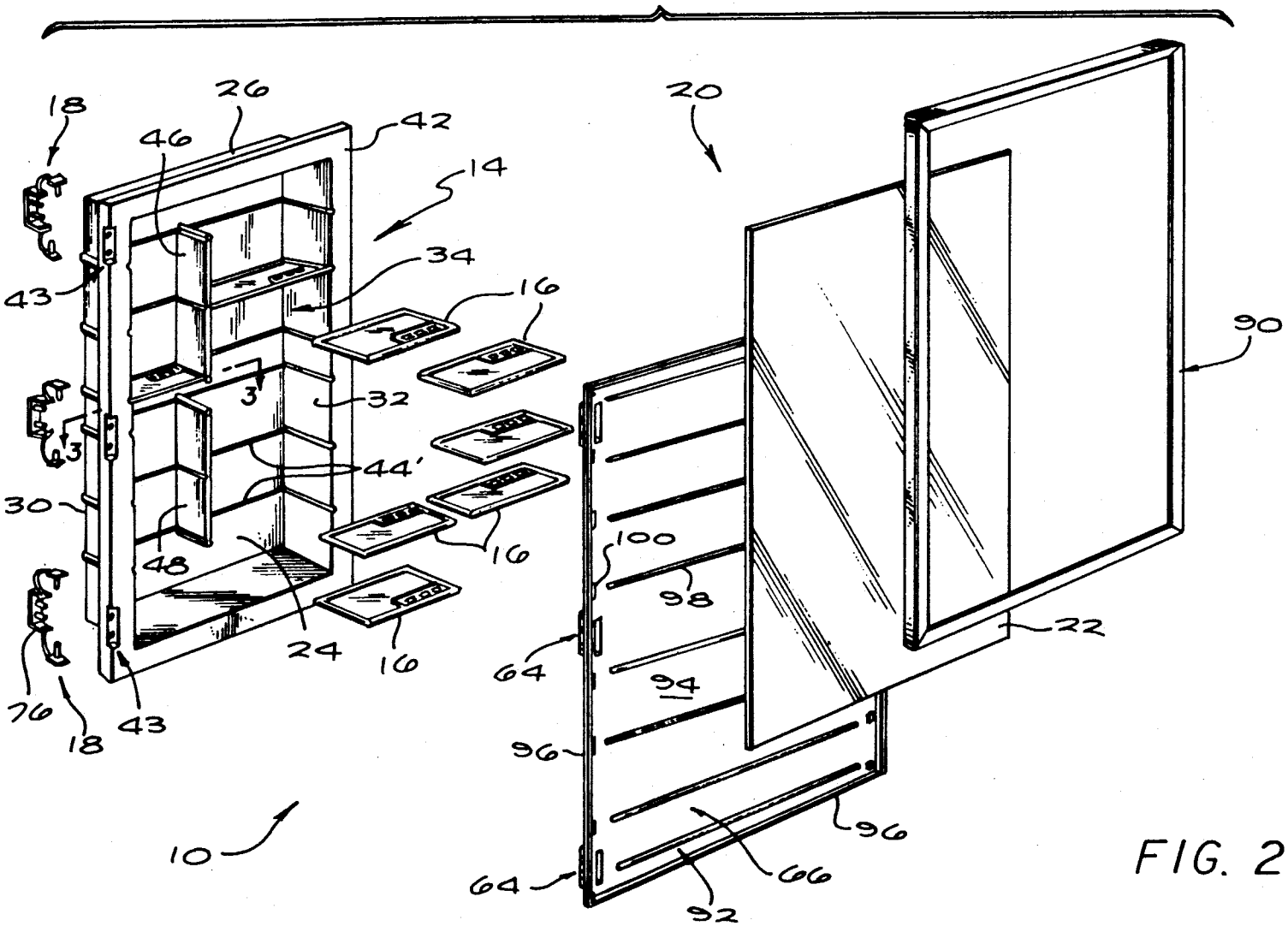
FIG. 2 is an enlarged and exploded perspective view illustrating assembly of the medicine cabinet components.

As shown in the exemplary drawings, an improved medicine cabinet referred to generally in FIG. 1 by the reference numeral 10 is provided for installation into the wall 12 of a residential bathroom or the like. The medicine cabinet 10 includes a main housing 14 adapted to receive a plurality of shelf members 16 (FIG. 2) in a custom arrangement, in combination with improved hinge assemblies 18 for supporting a mirror door 20 for self-closing and silent operation. Moreover, the mirror door 20 is designed to support a glass plate mirror 22 or the like in a simplified yet secure manner.

The improved medicine cabinet 10 of the present invention is designed to be manufactured easily and economically from lightweight molded plastic components, with the exception of the mirror 22. Importantly, the shelf members 16 have a half width construction to fit quickly and easily into the main cabinet housing 14 in a manner providing a customized array of half width and full width shelf areas of relatively tall clearance can be formed according to the needs of the individual user to receive and store taller articles such as bottles without requiring the excessive waste space attributable to a full width shelf with tall clearance. Similarly, one or more full width shelves may also be configured using the shelf members 16 to permit flat storage of larger yet low profile articles without wasted space. Moreover, the hinge assemblies 18 are designed for smooth and quiet operation without the use of metal hinge components, and the mirror door 20 is designed for rapid and facilitated assembly to support the fragile mirror 22 in a nested position protected against damage during shipment and/or installation procedures.

As shown best in FIGS. 2 and 6–8, the main housing 14 of the medicine cabinet 10 has a generally conventional size and shape to include a rear wall 24 which cooperates with a top wall 26, a bottom wall 28, and a pair of side walls 30 and 32 to define a forwardly open cabinet interior 34. The width of the housing 14 is chosen to fit with relatively close clearance between standard wall studs of a building wall 12, and the side walls 30 and 32 include preformed angled fastener ports 36 (FIGS. 6–8) for receiving suitable fasteners such as screws 38 (FIG. 8) fastened into an adjacent stud 40 to mount the housing in place. When installed onto the building wall 12, a peripheral facing strip 42 circumscribing the forward margins of the housing walls 26, 28, 30 and 32 lies flush against the building wall 12 and provides a decorative trim for the cabinet housing. Hinge mounting seats 43 are formed in the facing strip 42 at vertically spaced intervals adjacent the side wall 30 to accommodate swinging mounting of the mirror door 20, with the entire cabinet housing being invertable in accordance with the desired left- or right-hand mount of the mirror door.

Figures 6, 7:
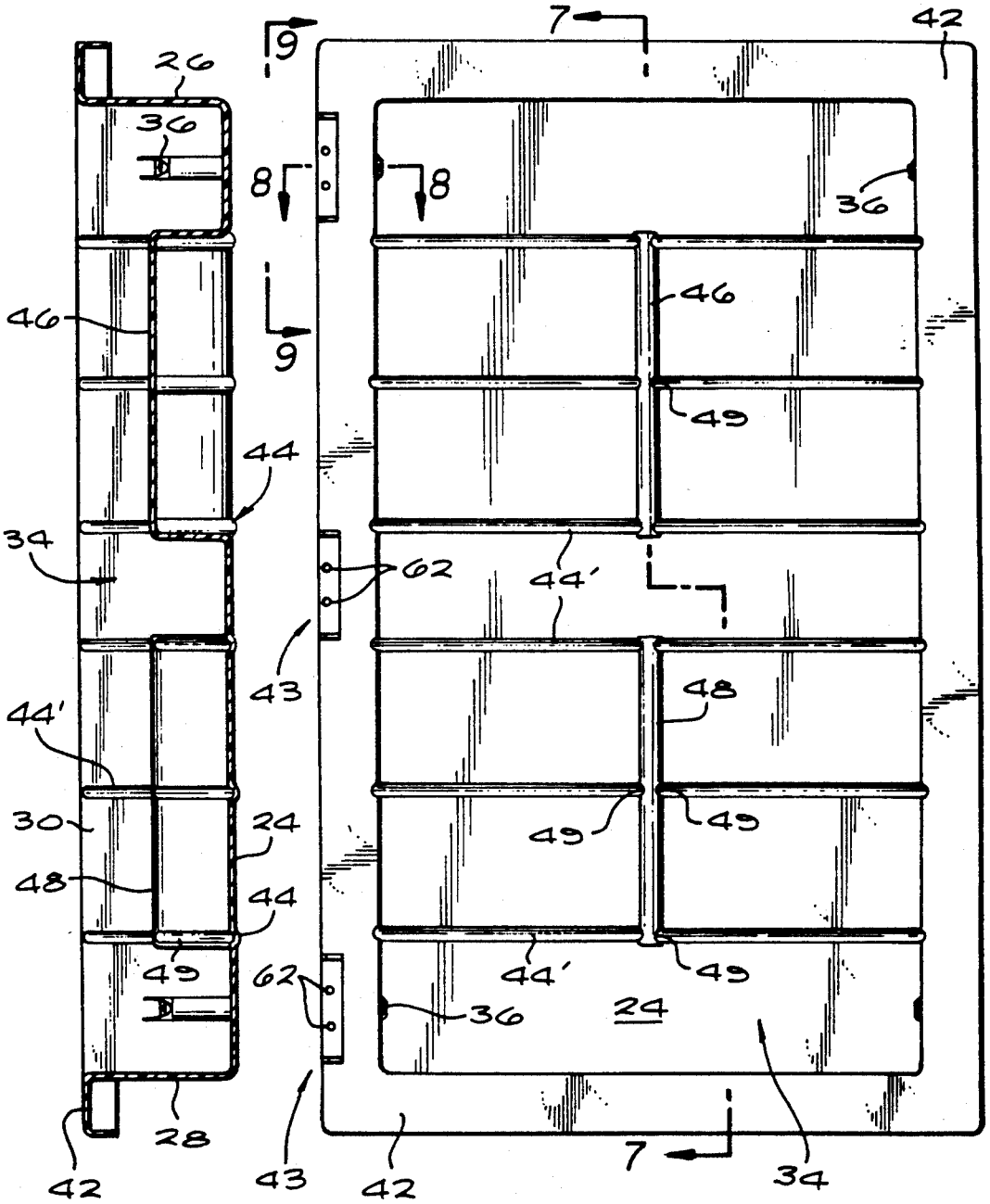
FIG. 6 is an enlarged rear elevation view of a main housing for the medicine cabinet.
FIG. 7 is a vertical sectional view taken generally on the line 7—7 of FIG. 6.

The illustrative cabinet housing 14 is adapted to be constructed as a unitary molding from a suitable lightweight plastic material. In this regard, the rear wall 24 and the two side walls 30 and 32 of the housing desirably include an array of horizontally extending stiffener ribs 44 formed at vertically spaced intervals which conveniently correspond with a plurality of shelf locations within the cabinet interior 34. As shown in FIGS. 2 and 7. These stiffener ribs are shaped as convex protrusions on the outboard or side of the housing, and as concave grooves 44, within the cabinet interior 34. These grooves 44,, as will be described, provide a convenient mounting structure for the shelf members 16.

The cabinet housing 14 further includes a pair of upright and centrally located shelf support brackets 46 and 48 formed integrally with the housing and positioned within the cabinet interior 34. These shelf brackets 46 and 48 generally divide the cabinet interior into vertically separated half width regions, as best depicted in FIG. 2. To facilitate plastic molding, the shelf brackets are hollow at rear sides thereof. Moreover, to permit easy installation of the shelf members 16, the brackets 46 and 48 include shallow grooves 49 formed in alignment with or as continuations of the grooves 44' in the housing walls.

In the preferred form, the illustrative shelf brackets 46 and 48 are vertically separated from each other to define a central opening within the cabinet interior communicating between the left and right sides of the brackets. In addition, the shelf brackets 46 and 48 are similarly spaced vertically from the top and bottom walls 26 and 28 of the housing 14 to provide additional openings between the opposite sides of the brackets. With this arrangement, as will be described in further detail herein, the medicine cabinet is designed to include a total of three uninterrupted shelves of full width spanning the entire distance between the opposite side walls 30 and 32.

The plurality of shelf members 16 are also constructed as lightweight plastic moldings and are adapted to fit with a smooth slide-fit into the housing grooves. More particularly, as viewed in FIGS. 2–5, a preferred shelf member geometry includes a generally rectangular plate 50 joined with a rounded peripheral bead 52. The length and width of the resultant shelf member 16 are chosen to provide half width units which fit into the grooves 44' in the housing side and rear walls, and additionally into the aligned groove 49 in the associated shelf bracket 46 or 48. By appropriate positioning of the multiple shelf members 16 as viewed in FIG. 2, it will be apparent that the cabinet interior can be subdivided into a customized geometry of full and half width shelves, with strategic omission of shelf members at one or selected positions providing one or more half width shelves of double height. Conveniently, each shelf member 16 may further include one or more apertures 54 along one edge thereof to permit toothbrushes or the like to be supported therein, with the shelf member being oriented to position these apertures at the front of the shelf when use is desired. Alternately, the shelf member aperture 54 can be positioned adjacent the rear wall 24 of the housing when use is not desired.

The hinge mounting seats 43 form a portion of the hinge assemblies 18 for swingably supporting the mirror door 20. More specifically, with reference to FIGS. 2, 6 and 8–10, each hinge mounting seat 43 is formed along the outboard corner or edge of the facing strip 42 in the shape of a generally rectangular pocket recessed into the outboard margin of the facing strip 42. The pocket is defined by a short wall segment 58 protruding rearwardly from the facing strip 42 and joined to a laterally outwardly projecting hinge support wall 60 having a pair of vertically spaced ports 62 formed therein. In a preferred form, three of the hinge mounting seats 43 are provided along one side of the main cabinet housing as shown in the accompanying drawings, although it will be understood that the specific number of hinge mounting seats may vary.

The hinge mounting seats 43 on the main cabinet housing 14 are adapted to receive preformed and integrally molded cam hinge units 64 formed along one side edge of a backplate 66 provided as a portion of the mirror door 20. This mirror door backplate 66 is shown in detail in FIGS. 11–16 to have a generally platelike rectangular shape with three of the cam units 64 projecting rearwardly from one side edge thereof. The cam units 64 each include a rearwardly projecting cam wall 68 defining a rounded, part-cylindrical cam surface oriented along a generally vertical axis and sized to fit into the pocket of an associated hinge mounting seat 43. A pair of contoured and complexly curved cam tracks 70 are formed in vertically spaced relation in the cam wall 68, with the preferred track geometry being best depicted in FIG. 19 in the form of a generally horizontally oriented hourglass shape. The cam wall 68 cooperates with the backplate 66 to define a small hollow interior volume within the cam unit 64, with the upper and lower extents being closed by small retainer plates 72 having pivot pin apertures 74 formed therein.

Individual hinge pin units 76 are provided for pivotally interlocking the cam units 64 within the hinge mounting seats 43, and thereby interconnect the mirror door baseplate 66 with the cabinet housing 14. One of these hinge pin units 76 is shown in detail in FIGS. 17 and 18 in a preferred form as a unitary plastic molding which eliminates any need for metal hinge components for the finished medicine cabinet. The illustrative hinge pin unit 76 comprises a pair of cam pins 78 projecting forwardly from a base strip 80. The upper and lower ends of the base strip 80 are joined to a pair of forwardly projecting lock tabs 82 which are joined in turn by a pair of flexible straps 84 to a corresponding pair of mating lock tabs 86 having pivot pins 88 thereon.

Figure 19:
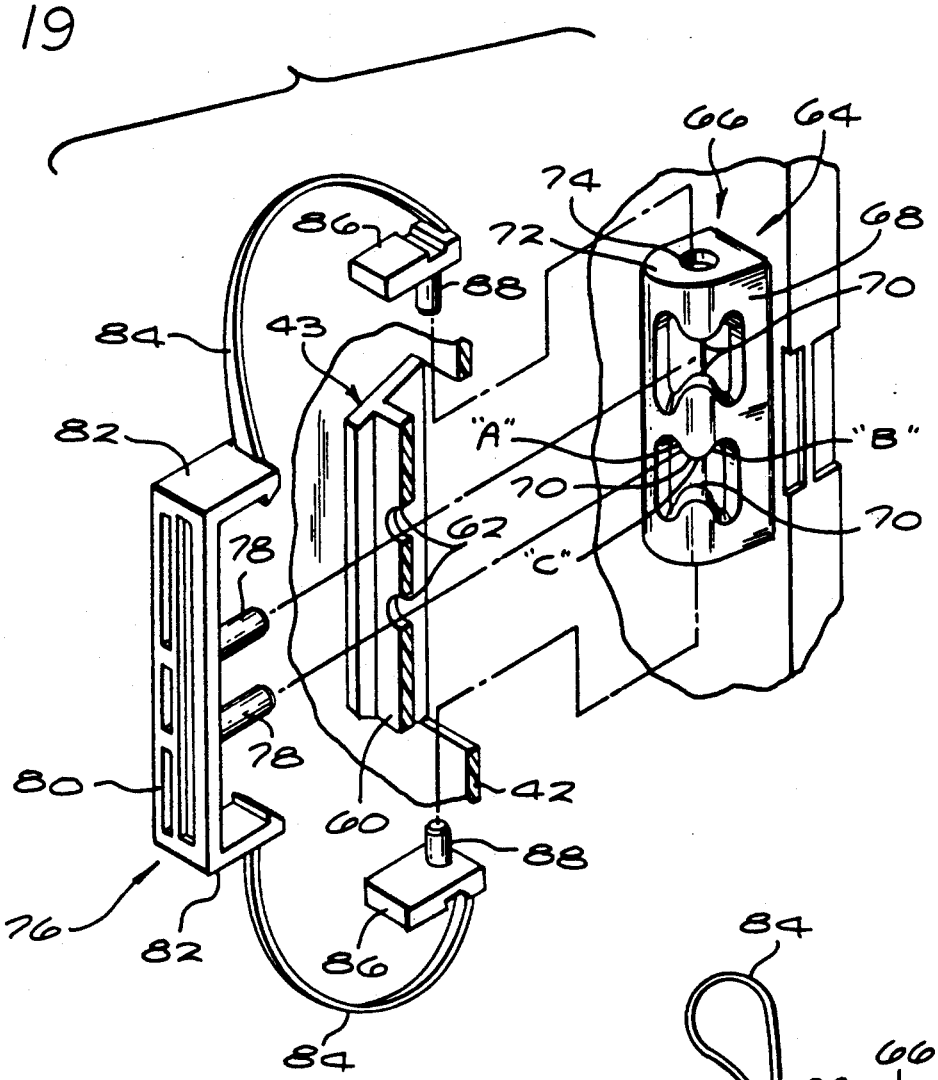
FIG. 19 is an exploded and fragmented perspective view showing assembly of the door baseplate with the main cabinet housing by use of the hinge pin unit.
Figure 20:
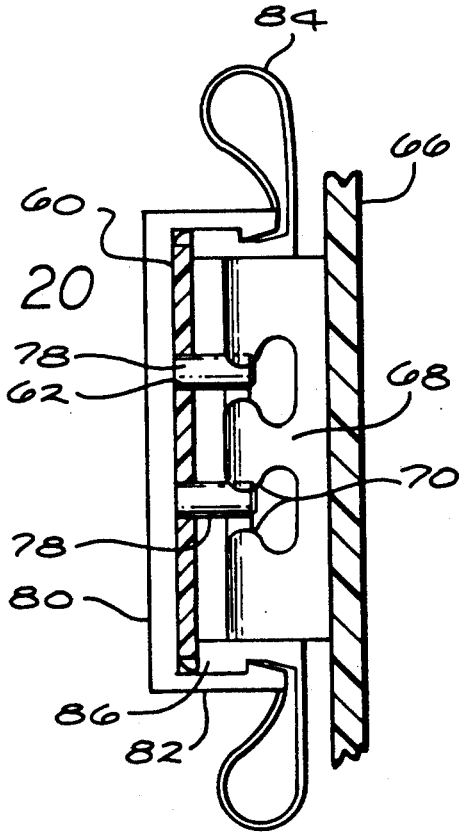
FIG. 20 is a fragmented vertical sectional view illustrating assembly of the hinge components depicted in FIG. 19.

The various components of the hinge assemblies 18 are assembled by positioning the cam hinge units 64 on the baseplate 66 into the mounting seats 43 of the main cabinet housing 14, as shown in FIGS. 19 and 20. The lock tabs 86 on the hinge pin units 76 are then oriented to place the pivot pins 88 into apertures 74 within the retainer plates 72 at the ends of the cam units 64. The base strip 80 is then advanced to a seated position flush against a rear side of the support wall 60, to position the cam pins 78 to extend through the support wall ports 62 and further to extend into the cam tracks 70 of the cam units 64. At the same time, the lock tabs 82 on the base strip 80 are advanced in overriding relation with the lock tabs 86 carrying the pivot pins 88, with snap-lock surfaces on the engaging lock tabs 82 and 86 holding the entire hinge assembly 18 securely in place. That is, the interlocked tabs hold the base strip 80 tightly against the support wall 60, and further prevent removal of the pivot pins 88 from the cam units 74.

The engagement between the cam pins 78 and the cam tracks 70 provides a quiet self-closing operation for the mirror door baseplate 66, without inclusion of metal components or springs. More specifically, the weight of the mirror door 20 causes the cam pins 78 to ride against the upper surfaces of the associated cam tracks 70, with the symmetric hourglass geometry conveniently accommodating reversible installation for left- or right-hand pivoting of the mirror door. When the mirror door is partially opened through an approximate angle of less than about forty five degrees, the pins engage a ramped portion "A" (FIG. 19), such that the weight of the mirror door 20 causes the door to be self-closing. Importantly, the size and shape of the track is designed for full door closure slightly before the cam pins 78 reach the end of the ramped portion "A", thereby insuring and maintaining full door closure. However, when the door 20 is opened through an approximate angle exceeding forty five degrees, the cam pins 78 engage an oppositely angled ramped portion "B" such that the door weight causes the mirror door to swing toward a fully open position. Finally, a narrow region "C" of the cam track disposed between the ramped portions "A" and "B" permits the door to be opened and held at an angular position of about forty five degrees.

With reference to FIGS. 2 and 11–16, the backplate 66 comprises a primary component of the mirror door 20 and is designed for assembly with a mirror frame 90 to support the fragile glass plate mirror 22 or the like in a secure and stable manner. The backplate is constructed as a plastic molding to define an enlarged and shallow cavity 92 for nested reception of the mirror 22 against a support plate 94 and within a border defined by a raised peripheral rim 96. Integrally molded stiffener ribs 98 are molded into the support plate 94 for added strength, and a plurality of forwardly convex leaf springs 100 are formed about the periphery of the support plate 94 for resiliently contacting and supporting the mirror 22.

The mirror frame 90 is also conveniently formed as a unitary plastic molding and is designed for snap-fit mounting onto the backplate 66 to retain the mirror 22 nested within the cavity 92. In this regard, the mirror frame 90 and the backplate 66 include interlocking snap-fit components for easy press-on assembly. However, it will be apparent that the nested mounting of the mirror 22 results in the mirror weight being physically carried by the backplate rim 96, with the mirror frame 90 preventing forward removal of the mirror from the backplate.

Figure 21:
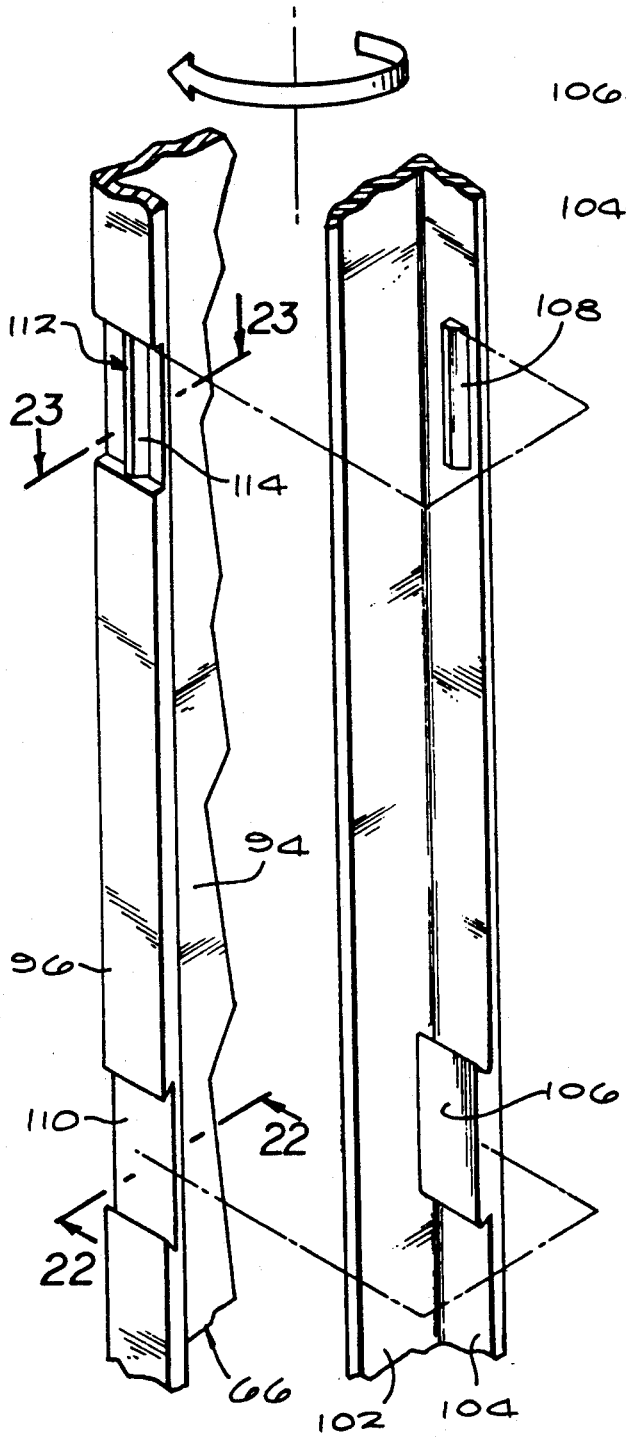
FIG. 21 is an enlarged and fragmented perspective view illustrating snap-fit assembly of a mirror frame onto the mirror door baseplate.
Figure 22:
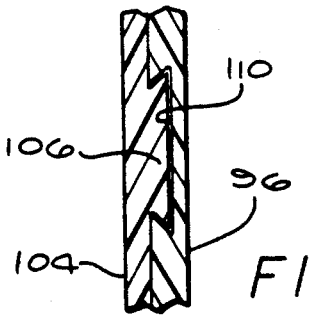
FIG. 22 is a fragmented horizontal sectional view taken generally on the line 22—22 of FIG. 21.
Figure 23:
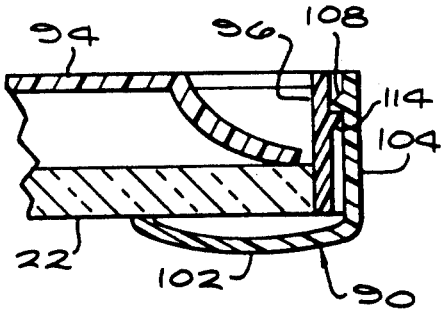
FIG. 23 is a fragmented horizontal sectional view taken generally on the line 23—23 of FIG. 21.

A preferred interlocking construction for the mirror frame 90 and the baseplate 66 is shown best in FIGS. 21–23. As shown, the illustrative frame 90 has a generally L-shaped configuration to include a decorative forward leg 102 to overlie the baseplate rim 96 and associated marginal edges of the mirror 22, together with a side leg 104 for snap-fit interlock with mating fastener structures on the outboard face of the baseplate rim 96. The preferred fastener structures include a spaced alternating array of dovetail keys 106 and snap-lock ribs 108 formed at the inboard face of the side leg 104 of the mirror frame 90. These components 106 and 108 are positioned for mating slide-fit reception into a dovetail slot 110 and a snap-lock channel 112 formed on the outboard face of the baseplate rim 96. The interfitting dovetail keys 106 and dovetail slots 110 prevent movement of the mirror frame 90 relative to the baseplate 66 in any direction except the fore-aft direction, while the snap-lock rib 108 or the frame 90 rides over and snap-fits behind a mating ramped snap-lock rib 114 within the channel 112 to prevent fore-aft movement. Accordingly, the frame 90 locks quickly yet securely onto the baseplate 66, with the forward frame leg 102 lightly pressing the fragile mirror 22 against the leaf springs 100. In this regard, the construction of the leaf springs 100 and the fore-aft depth of the backplate cavity 92 are formed to permit mounting of a mirror having different typical thicknesses known in the art.

Figure 24:
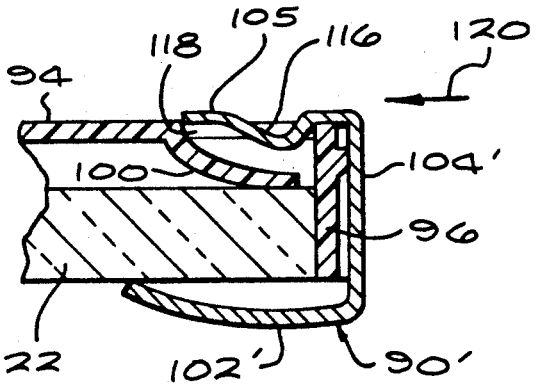
FIG. 24 is a fragmented horizontal sectional view similar to FIG. 23, but illustrating snap-fit mounting of an alternative mirror frame onto the mirror door backplate.

An alternative mirror frame is illustrated in section in FIG. 24, depicting a modified mirror frame 90' constructed as a lightweight metal component in accordance with the preferences of some persons who desire a metal or metallized trim appearance surrounding the glass mirror 22. This modified mirror frame 90' is designed for simple snap-fit installation onto the backplate 96, without requiring modifications to the backplate or other special support apparatus for the fragile mirror 22. As shown, the mirror frame 90' has a forward leg 102' for overlying the front margins of the mirror 22 and the backplate rim 96, together with a side leg 104' for overlying the outboard face of the backplate rim. The mirror frame 90, additionally includes a rear leg 105 positioned to fit behind the backplate rim and including plurality of forwardly convex spring tabs 116 which are struck from the rear leg 105 at positions corresponding with small apertures 118 in the support plate 94 adjacent each leaf spring 100. The support plate apertures 118 are an inherent result of the molding process of the backplate to form the leaf springs 100, and this provides convenient mounting sites to receive the spring tabs 116 of the mirror frame 90'. The modified mirror frame 90' can thus be formed for wrapping about each side of the baseplate by simple push-on, snap-fit mounting in the direction of arrow 120 in FIG. 24, and then appropriately locked onto the baseplate by means of a standard tab connection (not shown) at one corner thereof.

A variety of further modifications and improvements to the medicine cabinet 10 of the present Invention will be apparent to those skilled in the art. Accordingly, no limitation on the invention is intended by way of the foregoing description and accompanying drawings, except as set forth in the appended claims.

What is claimed is:

1. A medicine cabinet assembly, comprising;

a housing adapted for mounting into a building wall and defining a forwardly open interior chamber;

a mirror door; and hinge means for swingably mounting said mirror door onto said housing, said hinge means including a hinge mounting seat formed along one side edge of said housing, said hinge mounting seat including an open pocket lined on one side by a support wall having a cam pin port formed therein;

said hinge means further including a cam unit formed along one side edge of said mirror door, said cam unit including a cam wall having an open contoured cam track formed therein and further including a retainer plate having a pivot pin aperture formed therein;

said hinge means further including a hinge pin unit having a pivot member adapted for connection onto said hinge mounting seat and including a pivot pin receivable into said pivot pin aperture of said cam unit to retain said cam unit within said pocket, and a cam pin receivable through said cam pin port into engagement with said cam track when said cam unit is received within said pocket to guide opening and closing movement of said mirror door relative to said housing in accordance with the shape of said cam track.

2. The medicine cabinet assembly of claim 1 wherein said hinge means includes at least two of said hinge mounting seats in vertically spaced relation along one side edge of said housing, at least two of said cam units in vertically spaced relation along one side edge of said mirror door, and at least two of said hinge pin units.

3. The medicine cabinet assembly of claim 2 wherein said housing and said mirror door are adapted for reversible installation within a building wall.

4. The medicine cabinet assembly of claim 1 wherein said hinge pin unit is formed as a unitary plastic molding.

5. The medicine cabinet assembly of claim 4 wherein said pivot pin and said cam pin are respectively connected to a pair of interlocking snap-fit lock tabs, said lock tabs being interconnected by a flexible strap.

6. The medicine cabinet assembly of claim 2 wherein said cam track is shaped for gravitional self-closing of said mirror door when said door is partially opened to a selected angle relative to said housing, and for gravitional self-opening of said mirror door when said door is opened beyond a selected angle.

7. The medicine cabinet assembly of claim wherein said cam track is further shaped to retain said mirror door in a partially opened position when said door is opened substantially to a selected angle.

8. The medicine cabinet assembly of claim 1 wherein said hinge mounting seat includes a pair of said cam pin ports formed in said support wall, said cam unit including a pair of said retainer plates with a pair of said pivot pin apertures formed therein and a pair of said cam tracks, and said hinge pin unit including a pair of said pivot members having a pair of said pivot pins for reception into said pivot pin apertures, and a pair of said cam pins for reception through said cam pin ports and engagement with said cam tracks.

9. The medicine cabinet of claim 8 wherein said pivot members are respectively connected to opposite ends of said hinge pin unit by a pair of flexible straps, said pivot members and said hinge pin unit including interlocking lock tabs for positionally retaining said pivot members and said hinge pin unit with respect to each other.

* * * * *